US005116148A

United States Patent [19]

Ohara et al.

[11] Patent Number: 5,116,148

[45] Date of Patent: May 26, 1992

[54] HEAT TRANSFER INK SHEET HAVING A PRECOATING LAYER WHICH IS THERMALLY TRANSFERRED PRIOR TO SUBLIMATION OF AN INK DYE

[75] Inventors: Shuichi Ohara; Shiniichi Akasaka; Hiroyuki Oka, all of Hitachi; Shintaroo Hattori, Otsu; Rieko Oyama, Toyoake, all of Japan

[73] Assignee: Hitachi, Ltd., Tokyo, Japan

[21] Appl. No.: 528,893

[22] Filed: May 29, 1990

Related U.S. Application Data

[63] Continuation of Ser. No. 440,487, Nov. 24, 1989, abandoned, which is a continuation of Ser. No. 374,572, Jul. 3, 1989, abandoned, which is a continuation of Ser. No. 90,141, Aug. 27, 1987, abandoned.

[30] Foreign Application Priority Data

| | | | |
|---|---|---|---|
| Aug. 27, 1986 | [JP] | Japan | 61-198848 |
| Jan. 8, 1987 | [JP] | Japan | 62-997 |
| Feb. 12, 1987 | [JP] | Japan | 62-28252 |

[51] Int. Cl.[5] ..... B41J 31/09

[52] U.S. Cl. ..... 400/241; 400/120; 428/913

[58] Field of Search ..... 400/120, 140.3, 240.4, 400/241.1, 241, 241.2, 241.4; 101/470, 473; 428/913, 914; 346/76 PH, 106

[56] References Cited

U.S. PATENT DOCUMENTS

| | | | |
|---|---|---|---|
| 3,002,850 | 10/1961 | Fischer | 400/241.1 |
| 3,950,171 | 4/1976 | Nihyakumen et al. | 430/142 |
| 4,021,591 | 5/1977 | DeVries et al. | 101/473 X |
| 4,022,926 | 5/1977 | Keough et al. | 428/914 X |
| 4,058,644 | 11/1977 | DeVries et al. | 101/470 X |
| 4,310,258 | 1/1982 | Scott | 400/241.1 |
| 4,453,839 | 6/1984 | Findlay et al. | 400/241.1 X |
| 4,477,198 | 10/1984 | Bowlds et al. | 400/241.1 X |
| 4,505,603 | 3/1985 | Yana | 400/240.3 X |
| 4,527,171 | 7/1985 | Takanashi et al. | 101/470 X |
| 4,547,088 | 10/1985 | Shattuck | 400/241.1 |
| 4,551,729 | 11/1985 | Kubo et al. | 400/240.3 X |
| 4,558,329 | 12/1985 | Honda | 400/240.3 X |
| 4,562,443 | 12/1985 | Matsuno et al. | 400/240.3 X |
| 4,651,645 | 3/1987 | Kobayashi et al. | 101/470 X |
| 4,660,051 | 4/1987 | Sasaki | 400/120 |
| 4,756,633 | 7/1988 | Drees et al. | 101/470 X |
| 4,778,782 | 10/1988 | Ito et al. | 428/914 X |
| 4,815,872 | 3/1989 | Nagashima | 400/120 |

FOREIGN PATENT DOCUMENTS

| | | | |
|---|---|---|---|
| 148276 | 7/1985 | European Pat. Off. | 400/120 |
| 0169370 | 10/1982 | Japan | 400/120 |
| 0148778 | 9/1983 | Japan | 400/240.3 |
| 0148779 | 9/1983 | Japan | 400/240.3 |
| 0109393 | 6/1984 | Japan | 400/240.3 |
| 109394 | 6/1984 | Japan | 400/120 |
| 0169878 | 9/1984 | Japan | 400/241.1 |
| 1086289 | 5/1986 | Japan | 400/120 |
| 1237688 | 10/1986 | Japan | 400/120 |
| 8501698 | 4/1985 | World Int. Prop. O. | 400/240.4 |

OTHER PUBLICATIONS

McGraw-Hill Encyclopedia of Science and Technology, 1971, pp. 656-659.

*Primary Examiner*—David A. Wiecking

*Attorney, Agent, or Firm*—Antonelli, Terry, Stout & Kraus

[57] ABSTRACT

The present invention provides a heat transfer process and a heat transfer ink sheet, where a letter or image or both is recorded by selectively heating a heat transfer ink sheet having ink layer regions each containing a sublimable or vaporizable dye by heating by a thermal head controlled by a controlling means, thereby selectively heat transferring the sublimated or vaporized dyes onto a recording sheet, and is characterized by heat transferring a precoating layer for receiving the dyes from the ink sheet onto the recording sheet before the heat transfer recording, and then pressing the ink sheet on the transferred precoating layer on the recording sheet and heating the ink sheet by the thermal head, thereby sublimating or vaporizing the dyes from the respective ink layers onto the precoating layer and forming the letter or image or both on the recording sheet.

10 Claims, 4 Drawing Sheets

HEAT TRANSFER INK SHEET HAVING A PRECOATING LAYER WHICH IS THERMALLY TRANSFERRED PRIOR TO SUBLIMATION OF AN INK DYE

This application is a continuation of application Ser. No. 07/440,487, filed Nov. 24, 1989 which is a continuation of application Ser. No. 07/374,572, filed Jul. 3, 1989, which was a continuation of application Ser. No. 07/090,141, filed Aug. 27, 1987, all now abandoned.

BACKGROUND OF THE INVENTION

This invention relates to heat transfer recording, where a desired letter or an image or both is to be recorded on a recording sheet by heating, and more particularly to a heat transfer printer and a heat transfer process capable of recording on an ordinary, versatile sheet of paper a heat-sublimable or vaporizable dye without using any specific recording sheet, and to a heat transfer ink sheet.

The heat transfer ink sheet so far used in the heat transfer printers is such a heat transfer ink sheet that a dye is fixed on a substrate sheet by a binder as an ink layer, where recording is carried out by heating the heat transfer ink sheet, as laid on a recording sheet, by a heating means, thereby selectively transferring the dye as a sublimable or vaporizable dye or a meltable ink in the ink layer onto the recording sheet in accordance with a letter or an image or both. However, in the case of the meltable ink, it is hard to obtain a tonal graduation. In recording a full color image having a tonal graduation, generally an ink sheet containing a sublimable or vaporizable dye is widely used.

One example each of a conventional heat transfer printer and a heat transfer ink sheet will be described below according to the disclosure of Japanese Patent Application Kokai (Laid-open) No. 57-169370. A heat transfer ink sheet comprises a substrate sheet and an ink layer laid thereon. The substrate sheet (base film) is composed of polyethylene terephthalate, etc., and the ink layer is a layer comprising a sublimable or vaporizable dye fixed by a binder resin, etc. A heat transfer printer comprises a platen rubber roller and a thermal head. The heat transfer ink sheet is laid on a recording sheet so that the ink layer of the ink sheet may be in contact with the recording sheet, and passed between the platen rubber roller and the thermal head under a pressing load. At the same time, the contact part is heated by the thermal head, while controlling the heating temperature and the heating time, thereby transferring the dye to the recording sheet from the ink layer. The recording sheet for use in the heat transfer is limited, and a specific sheet is used. That is, a polyester sheet, a polyester-treated sheet, a cross-linked polyester-treated sheet, a sheet treated with a mixture of polyester with polyvinylpyrrolidone, etc. have been used as the recording sheet. In other words, a specific sheet comprising a sheet and a polyester-based resin, etc. readily dyeable with a sublimable or vaporizable dye, as applied thereto, has been used as such a recording sheet.

When the commercially available, ordinary, versatile sheet is used as recording paper in place of a specific recording sheet together with a heat transfer ink sheet comprising a sublimable or vaporizable dye, the letter or image or both transferred onto the recording paper by the sublimable or vaporizable dye from the heat transfer ink sheet has such problems as being weak and less discriminate, and has poor recording preservability.

A specific recording sheet has no such problems, but is expensive and is not easily available owing to the limited versatility.

SUMMARY OF THE INVENTION

A first object of the present invention is to provide a heat transfer printer capable of clearly recording a letter or image or both on an ordinary, versatile paper sheet as a recording sheet in the heat transfer recording, using a sublimable or vaporizable dye.

A second object of the present invention is to provide a process for clearly recording a letter or image or both on an ordinary, versatile paper sheet as a recording sheet in the heat transfer recording, using a sublimable or vaporizable dye.

A third object of the present invention is to provide an ink sheet for heat transferring a letter or image or both onto an ordinary, versatile paper sheet as a recording sheet in the heat transfer recording, using a sublimable or vaporizable dye.

A fourth object of the present invention is to provide an ink sheet for clearly recording a letter or image or both on an ordinary, versatile paper sheet as a recording sheet in the heat transfer recording, using a sublimable or vaporizable dye, where the heat transfer ink sheet is less adhesive to the recording sheet during the heat transfer.

Other objects of the present invention will be described in the following disclosure.

According to the present invention, the heat transfer ink sheet for use in a heat transfer printer, comprises a base film and an ink layer containing a heat-sublimable or vaporizable dye, formed on the base film. The ink sheet is laid on a recording sheet and is subjected to selective heat supply from a thermal head controlled by a controller, thereby selectively heat transferring the dye onto the recording sheet through sublimation or vaporization of the dye to form a letter or image or both on the recording sheet. The heat transfer ink sheet includes a precoating layer region provided on the same base film as the ink layer, the precoating layer being capable of being transferred and deposited on the recording sheet by pressing the ink sheet onto the recording sheet with heating just before being introduced into the heat transfer printer. By such pressing and heating a precoating layer having a compatibility with, or intimacy or affinity toward the dye on the recording sheet is formed.

Heretofore, no clear letter or image has been obtained on an ordinary, versatile paper sheet when using a sublimable or vaporizable dye. The present invention overcomes this disadvantage by forming a precoating layer for receiving dye on the site to be printed on the recording sheet just before being introduced into the heat transfer printer. Furthermore, the formation of the precoating layer can be used in a known heat transfer printer without using any special device, other than the improved ink sheet of the present invention.

In the present invention, an ink sheet has an ink layer region and a precoating layer region provided discretely one after another on the same base film. The precoating layer is heat transferred from the ink sheet and deposited onto the site to be printed on an ordinary, versatile paper recording sheet. Then, the ink sheet is moved to place the ink layer region on the precoating layer deposited on the recording sheet and is subjected to heat transfer. That is, the ink sheet has the precoating layer regions and the ink layer regions provided alternately one after another on the base film. In the case of multicolored printing, ink layer regions of different colors are arranged in a given succession with respect to the precoating layer regions, and it is desirable that the succession be repeated.

The precoating layer formed on the base film is composed of an organic material having a heat-transfer temperature of 50° to 250° C. for transfer onto the ordinary, versatile paper sheet. The organic material preferably has at least one of an ester bond and an amide bond. For example, an organic material composed of at least one of polyester resin, polyamide resin, higher fatty acid esters and higher fatty acid amides is used. Polyester resin having a number average molecular weight of 2,000 to 10,000 is particularly preferable. The polyester resin has a good susceptibility to dying and is less adhesive to the ink layer during the image transfer recording.

To prevent the adhesion of the ink sheet to the recording sheet during the image transfer recording, it is preferable to form an adhesion-preventing layer on the ink layer. As the adhesion-preventing layer, a film comprising a silicone resin is preferable. The desirable film thickness is not more than 1 μm. The adhesion or fusion prevention between the ink sheet and the recording sheet can be improved thereby. By further forming the silicone resin layer between the precoating layer and the base film, transfer and deposition of the precoating layer to the ordinary, versatile paper sheet can be facilitated and also unwanted adhesion to the ink sheet can be prevented during the image transfer recording. As the silicone resin, heat or photo curable type silicone resin is preferable.

The base film for the ink sheet to be used in the present invention includes, for example, a thin leaf sheet such as condenser paper, etc., and films of polyimide, polycarbonate, acetyl cellulose, polyethylene terephthalate, etc. The base film may sometimes undergo sticking due to the heat from a thermal head. To prevent the sticking, a thin film layer of heat-resistant resin such as silicone resin, melamine resin, etc. may be formed on the contact surface side (opposite side to the ink layer-formed side) with the thermal head.

Formation of the precoating layer on the recording sheet is carried out by laying the precoating layer region of the ink sheet on the recording sheet under a pressing load and heating the site of the recording sheet at which the precoating layer is to be formed, thereby transferring and depositing the precoating layer onto the recording sheet. It is preferable to make selective heating by means of the thermal head for recording a letter or image or both, thereby forming a precoating layer at the necessary site of the recording sheet for recording the letter or image or both. The ink sheet may be in a tape form, a ribbon form, a film form, etc.

DETAILED DESCRIPTION OF PREFERRED EMBODIMENTS

Figure 1:
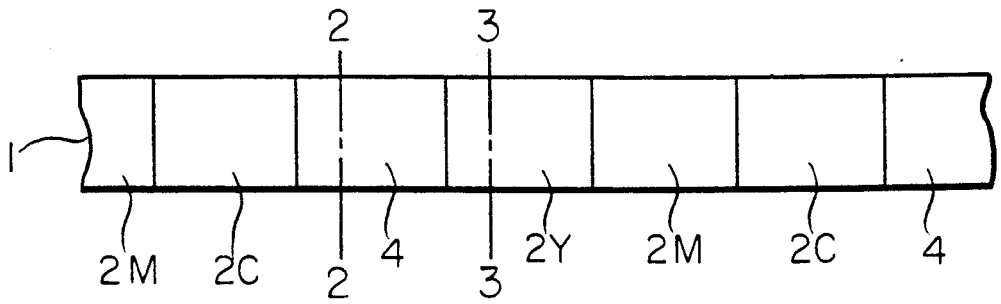
FIG. 1 is a plan view of a heat transfer ink sheet according to one embodiment of the present invention.
Figure 2:
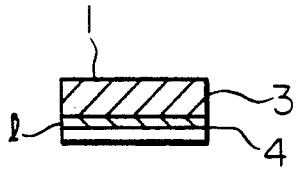
FIG. 2 is a cross-sectional view along the line 2—2 of FIG. 1.
Figure 3:
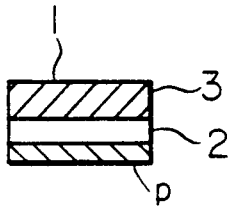
FIG. 3 is a cross-sectional view along the line 3—3 of FIG. 1.

The present heat transfer ink sheet will be described in detail below, referring to FIGS. 1 to 3, where FIG. 1 shows a plan view of one embodiment of the present heat transfer ink sheet 1, FIG. 2 is a cross-sectional view along the line 2—2 of FIG. 1, and FIG. 3 is a cross-sectional view along the line 3—3 of FIG. 1.

Base film 3 is a sheet of polyethylene terephthalate, etc., and precoating layer regions 4 are provided on the base sheet in parallel to one another and in positions adjacent to ink layer regions 2 each containing a sublimable or vaporizable dye of individual primary color.

According to the present embodiment, primary colors of Yellow, Magenta and Cyan are used as dyes, and thus Yellow ink layer regions 2Y, Magenta ink layer regions 2M and Cyan ink layer regions 2C are laid discretely on the base film 3. One heat-transferable precoating layer region 4 is provided between a Yellow ink layer region 2Y and a Cyan ink layer region 2C. In this manner, precoating layer regions 4, Yellow ink layer regions 2Y, Magenta ink layer regions 2M and Cyan ink layer regions 2C are arranged in succession and in a repeated manner.

FIG. 2 is a cross-sectional view along the line 2—2 of the precoating layer region 4 in FIG. 1, where the precoating layer 4 is laid on the base film 3, and FIG. 3 is a cross-sectional view along the line 3—3 of Yellow ink layer region 2Y in FIG. 1, where the ink layer 2 containing a heat-sublimable or vaporizable dye and a binder resin is laid on the base film 3. The Magenta ink layer regions 2M and the Cyan ink layer regions 2C have the same structure as shown in FIG. 3.

A process for transferring to a recording sheet with the said heat transfer ink sheet will be described below with reference to FIG. 10.

A heat transfer ink sheet 11 is laid on a recording sheet 17 so that the precoating layer 13 of the heat transfer ink sheet 11 can be brought into contact with the recording sheet 17, and then supplied to a heat transfer printer. By heat from a thermal head 18, or the like as a heating means of the printer, the precoating layer 13 is transferred from the heat transfer ink sheet 11 onto the recording sheet 17. Then, the transfer ink sheet 11 is moved forward, and the successive Yellow ink layer region 14 is laid on the transferred precoating layer 13 on the recording sheet 17, and the sublimable or vaporizable Yellow dye is heat transferred to the transferred precoating layer 13 only in an amount according to an image signal. Then, the sublimable or vaporizable Magenta dye and the sublimable or vaporizable Cyan dye are likewise heat transferred to the recording sheet 17 in succession, and ultimately a desired full color image can be obtained after the dyes of primary colors have been heat transferred onto the transferred precoating layer 13 on the recording sheet 17 according to the respective image optical densities.

In the foregoing embodiment, recording a full color image by the transfer of Yellow, Magenta and Cyan in succession has been described, but the order of dyes of primary colors to be transferred is not limited, as long as the precoating layer 13 is at first transferred to a recording sheet 17. Furthermore, the present invention is not limited to color recording, but can be applied to recording with only sublimable or vaporizable black dye.

As described above, the precoating layer 13 is first transferred to a recording sheet 17, and then sublimable or vaporizable dyes are transferred onto and received by the transferred precoating layer 13 in the present invention, and thus an ordinary, versatile paper sheet can be used in the present invention as a recording sheet 17.

As the dye for the ink layer 14, 15 or 16, those which can be sublimated or vaporized by heat from a thermal head 18, etc. can be used and include, for example, C.I. (Color Index) Disperse yellow 16, C.I. Solvent Red 146, C.I. Solvent Blue 36 and TS Blue 603 (products made by Sumitomo Kagaku Kogyo K.K., Japan), Kayalon Fast Orange, Kayalon Fast Blue and Kayalon Fast Green (products made by Nihon Kayaku K.K., Japan), Dianix Fast Yellow (a product made by Mitsubishi Kasei Kogyo K.K., Japan), Aizen QZ Red (a product made by Hodogaya Kagaku Kogyo K.K., Japan), etc. Furthermore, quinazoline dye, disperse monoazo dye, disperse anthraquinone dye, disperse nitrodiphenylamine dye, smoke dye, etc. can be also used.

As a binder for fixing these dyes to the base film 12, a resin having a high adhesiveness to the base film 12 is used, and particularly polyester resin, polyamide resin, cellulose resin, etc. are preferable.

Materials for the precoating and dye-receiving layer 13 are preferably those having a softening temperature or melting temperature of 50° to 250° C. The heat transfer ink sheet 11 is usually kept in a rolled state, and thus if the softening temperature or the melting temperature of the precoating layer 13 is below 50° C., the precoating layer 13 may be transferred to the back of the base film 12 or may become adhesive during storing or transportation. However if the melting temperature of the precoating layer 13 exceeds 250° C., it will be difficult to heat transfer the precoating layer 13 from the heat transfer ink sheet 11 to the recording sheet 17 by the same amount of heat as that used when an image is recorded. Needless to say, it is possible to solve this problem by increasing the amount of heat from a thermal head 18, but such measures are not preferable, because of increased power consumption of the heat transfer printer, decreased life of the thermal head 18, occurrence of sticking phenomena, etc.

Specific materials for the precoating layer 13 preferably comprise compounds having at least one of an ester bond and an amide bond in the molecule as the main constituent, whereby the precoating layer 13 is readily dyed with a sublimable or vaporizable dye.

The precoating layer 13 can contain appropriate amounts of an antistatic agent, an ultraviolet absorbing agent, metal powder capable of increasing the heat conductivity, a surface lubricant capable of increasing transferability, and other additives to meet other requirements.

In the heat transfer printer, a means for heating the present heat transfer ink sheet 11 in contact with the recording sheet 17 is not limited to a thermal head 18, but rather a laser device, a thermal pen, a thermal printing type, etc. can also be used. The heat transfer ink sheet 11 and the recording sheet 17 are heated while controlling the heating temperature and the heating time of the heating means by a controller 26 according to electric signals of the colors. In the present invention, a clear full color image can be recorded on an ordinary, versatile paper recording sheet 17.

For the heat-transferable precoating layer 13, polyester resin having a number average molecular weight of 2,000 to 10,000 and a softening temperature of 80° to 150° C. is preferable. Below 80° C., the heat transfer ink sheet 11 having such a precoating layer 13 has a poor preservability, whereas above 150° C. the heat transferability of the precoating layer 13 is deteriorated. When polyester resin is used as a precoating layer 13 to be transferred to an ordinary, versatile paper sheet 17, a very good heat transferability to the sheet 17 can be obtained. Furthermore, the precoating layer 13 of polyester resin can be readily dyed with a sublimable or vaporizable dye, and thus a high quality image equivalent to that obtained on a specific recording sheet such as those described above having a polyester based resin applied thereto can be obtained.

As shown in FIG. 3, an adhesion-preventing layer P may be provided on the ink layer 2. The thickness of the adhesion-preventing layer P is preferably not more than 1 μm. Above 1 μm, sublimation or vaporization and diffusion of sublimable or vaporizable dye from the ink layer 2 to the transferred precoating layer 13 on the recording sheet 17 becomes difficult during the heat transfer recording, resulting in unclear printing of low optical density. If no adhesion-preventing layer P is provided on the ink layer 2, trouble may occur during the heat transfer recording of a sublimable or vaporizable dye from the ink layer 2 onto the transferred precoating layer 13 on the recording sheet 17. That is, the precoating layer 13 is composed of a heat-transferable material, i.e. a heat-melting or softening material, and thus may be melted or softened by the heat for heat transferring the sublimable or vaporizable dye, resulting in adhesion of the transferred precoating layer 13 to the ink layer 2. The adhesion force depends upon the species of the binder contained in the ink layer 2, the species of a material as a constituent for the transferred precoating layer 13, heat transfer conditions for sublimable or vaporizable dye, etc. A high adhesion force makes it difficult to separate the ink sheet 1 or 11 from the recording sheet 17, resulting in peeling of the ink layer 2 from the base film 3 (as called "abnormal transfer"), or peeling of the transferred precoating layer 13 from the recording sheet 17, or failure of ink sheet 1 or 11 travelling, or, breakage of the ink sheet 1 or 11. When the adhesion-preventing layer P is provided on the ink layer 2, the precoating layer 13 will have no stronger adhesion force because of the non-adhesion action of the adhesion-preventing layer P even if the precoating layer 13 is melted or softened.

Likewise, the transferability of a precoating layer 4 or 13 depends upon the species of a material as a constituent for the precoating layer 4 or 13, the species of the recording sheet 17, conditions for heat transfer, etc., when the precoating layer 4 or 13 is heat transferred from the base film 3 or 12 onto the recording sheet 17. Thus, in some cases the transfer of the precoating layer 4 or 13 is incomplete, depending upon these conditions. Furthermore, when the precoating layer 4 or 13 is less separable from the base film 3 or 12 or when the adhesion is strong between the base film 12 and the precoating layer 4 or 13, separation of the ink sheet 1 or 11 from the recording sheet 17 becomes difficult after the transfer of the precoating layer 4 or 13, resulting in failure of ink sheet 11 travelling or breakage of the ink sheet 1 or 11.

To solve these problems, a separation-facilitating layer l is also provided between the base film 3 or 12 and the precoating layer 4 or 13 as shown in FIG. 2, whereby the precoating layer 4 or 13 can be stably and uniformly heat transferred onto the recording sheet 17, and adhesion of the heat transfer ink sheet 11 to the recording sheet 17 can be prevented. Thus, the travelling trouble of the ink sheet 11 can also be overcome thereby.

EXAMPLE 1

FIGS. 1, 2 and 3 are schematic views showing one embodiment of the present invention, where numeral 1 is a heat transfer ink sheet, which comprises a substrate 3 in a sheet form, composed of polyethylene terehthalate and heat-transferable precoating layer regions 4, Yellow ink layer regions 2Y, Magenta ink layer regions 2M and Cyan ink layer regions 2C provided alternately in succession on the surface of the substrate 3. The precoating layer 4 was composed of polyamide resin having a softening temperature of about 110° C. (Versamid 930, a product made by Henkel Japan K.K., Japan). The Yellow ink layer 2Y was composed of a mixture of one part by weight of C.I. (color index) Disperse Yellow 16 as a yellow sublimable dye and 2 parts by weight of polyester resin (Vylon 290, a product made by Toyobo K.K., Japan) as a binder resin. The Magenta ink layer 2M had the same composition as that of the Yellow ink layer 2Y, except that one part by weight of C.I. Solvent Red 146 was used as a Magenta sublimable dye in place of the yellow dye. The Cyan ink layer 2C had the same composition as that of the Yellow ink layer 2Y except that one part by weight of C.I. Solvent Blue 36 was used as a Cyan sublimable dye in place of the yellow dye.

The heat transfer ink sheet 1 was subjected to recording together with a Xerox 4024 paper (Bekk smoothness: about 50 seconds), which was a most popular ordinary paper recording sheet 17 for electrophotographic copying, by applying a voltage of 6.5 V to a thermal head 18 having many heat-generating resistor elements (electrical resistance: 210 Ω; element density: 6 elements/mm). The whole precoating layer region 4 could be transferred from the heat transfer ink sheet 1 onto the recording sheet 17 in 20 m sec. time of passing a current to the thermal head 18 (turn-on time), per line of the thermal head 18. From the Yellow ink layer region 2Y, Magenta ink layer region 2M, and the Cyan ink layer region 2C could be transferred Yellow, Magenta and Cyan, respectively, in succession for a turn-on time of less than 30 m sec. according to the respective image signals, whereby a clear full color image could be ultimately recorded on the ordinary, versatile paper sheet 17.

Figure 4:
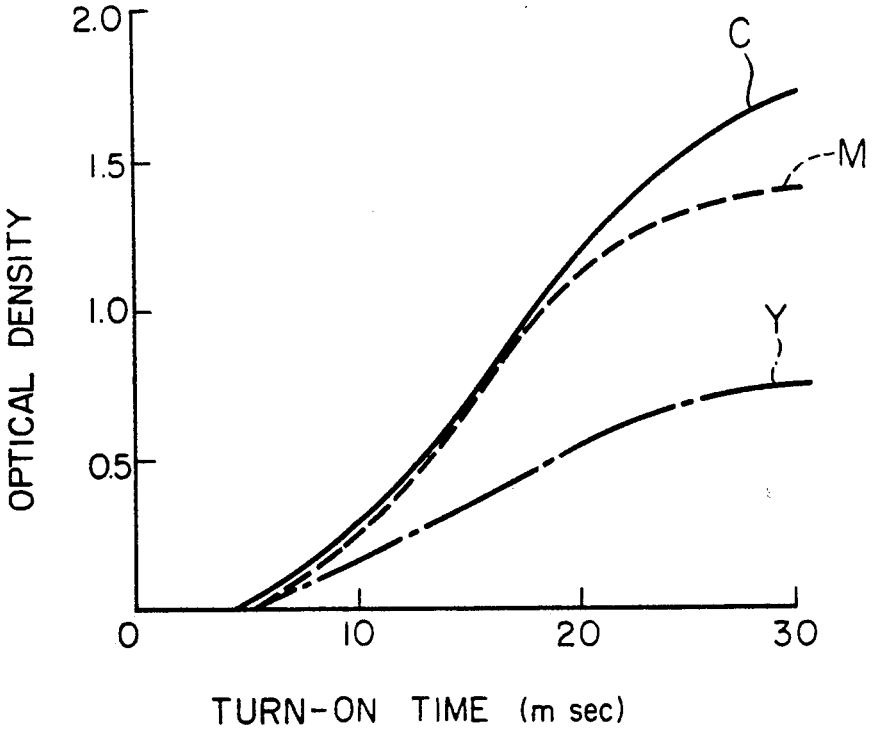
FIGS. 4, 8 and 9 are diagrams showing relationships between the turn-on time and the optical density each for primary colors when the heat transfer ink sheet of the present invention is combined with an ordinary, versatile recording sheet.

Relationships between the turn-on time for heating and the optical density of recorded images when the precoating layers 13 were transferred from the heat transfer ink sheet 1 onto the paper recording sheet 17 and Yellow, Magenta and Cyan dyes were transferred thereto singly are shown in FIG. 4, where curve Y shows Yellow, curve M Magenta and curve C Cyan. Each color had a high tonal graduation, and clear, high quality recordings could be obtained in this Example.

COMPARATIVE EXAMPLE 1

Figure 5:
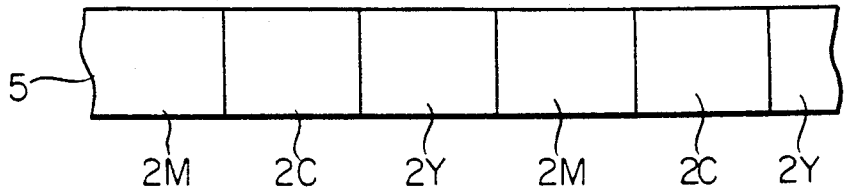
FIG. 5 PRIOR ART
FIG. 5 is a plan view of a conventional heat transfer ink sheet.
Figure 6:
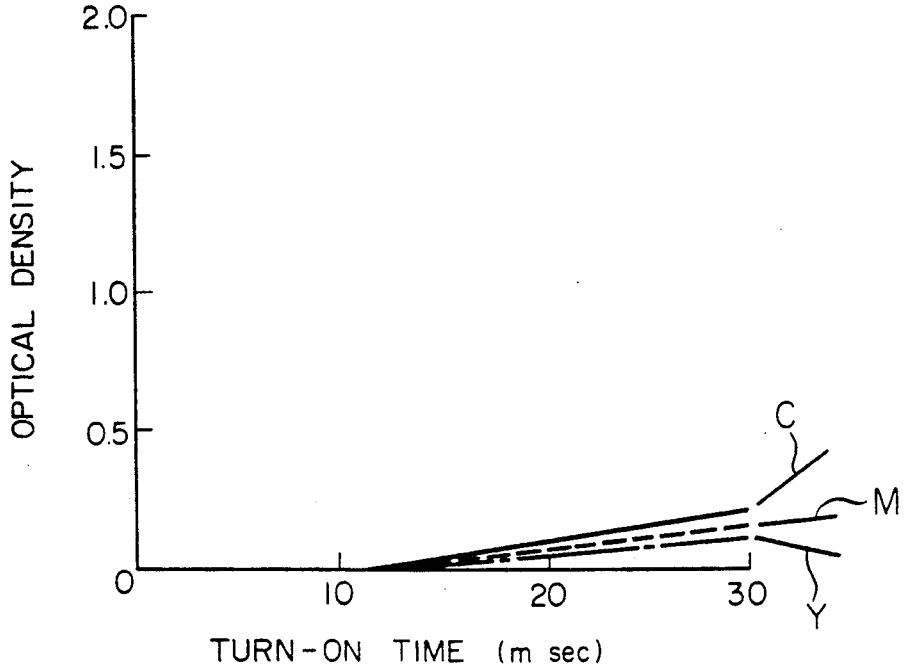
FIG. 6 is a diagram showing a relationship between the turn-on time and the optical density for primary colors when a conventional heat transfer ink sheet is combined with an ordinary, versatile recording sheet.

A conventional heat transfer ink sheet 5 having no precoating layer was used, and its structure is shown in FIG. 5 by way of a plan view, where a heat transfer ink sheet 5 comprises a base film and Yellow ink layer regions 2Y, Magenta ink layer regions 2M, and Cyan ink layer regions 2C provided alternately in succession on the surface of the base film 12. The heat transfer ink sheet 5 was subjected to recording in the same manner as in Example 1 together with the same Xerox 4024 paper as used in Example 1 as a recording sheet 17. Relationships between the turn-on time for heating and the optical density of recorded images for each of Yellow, Magenta and Cyan dyes are shown in FIG. 6, where curve Y shows Yellow, curve M Magenta and Curve C Cyan. It can be seen from comparison with the results of the present heat transfer ink sheet 1 shown in FIG. 4 that each of the colors had a lower optical density and no practical recording could be obtained without using the precoating layer of the present invention. Furthermore, a color image obtained by transferring primary colors one upon another had a low optical density and only an obscure recording could be obtained without the precoating layer.

Figure 7:
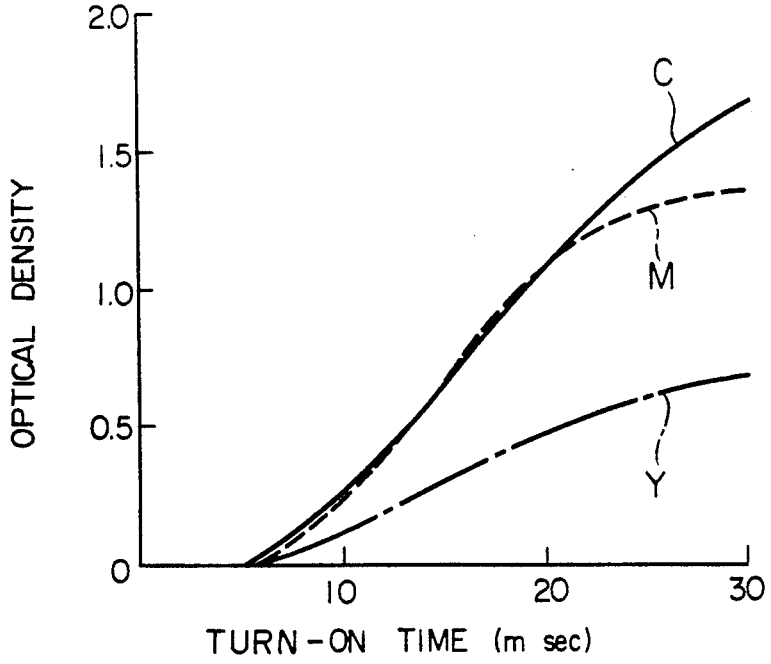
FIG. 7 is a diagram showing a relationship between the turn-on time and the optical density for primary colors when a conventional heat transfer ink sheet is combined with a specific recording sheet.

With a specific sheet for sublimation type heat transfer as a recording sheet 17 (polypropylene-based synthetic sheet coated with polyester resin) and with the ink sheet 5 as shown in FIG. 5, relationships between the turn-on time for heating and the optical density of recorded images for each of the primary colors were investigated, and the results are shown in FIG. 7.

It is obvious from FIG. 7 that the corresponding curves of FIG. 7 and FIG. 4 are substantially identical with each other, and thus the present invention can attain an effect equivalent to that obtained with the specific recording sheet described above.

EXAMPLE 2

Figure 8:
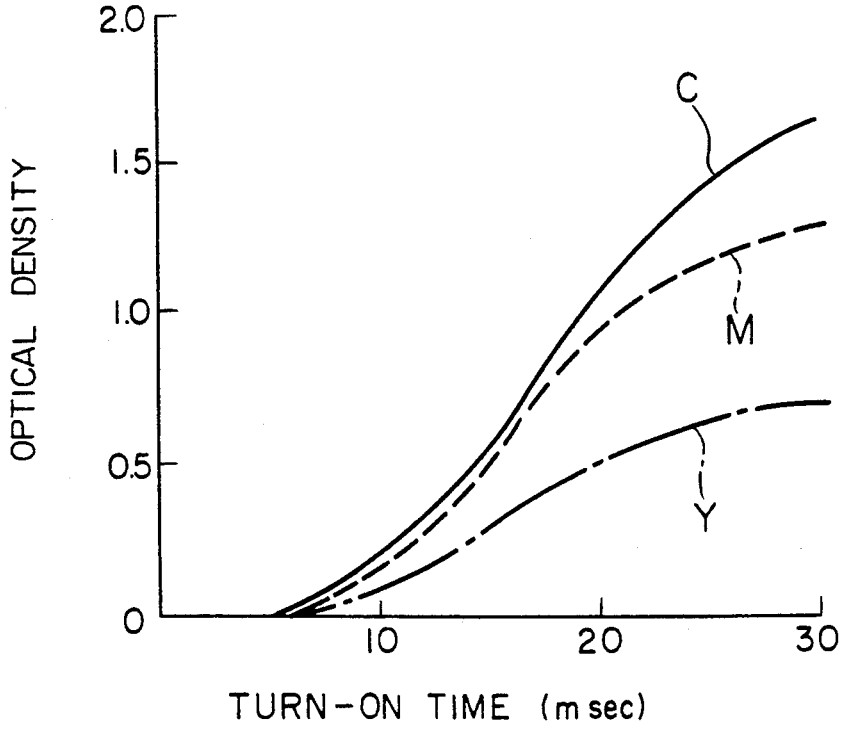

With the same heat transfer ink sheet 1 as used in Example 1 except that the mixture of 6 parts by weight of polyamide resin having a softening temperature of about 120° C. (Versamid 756, a product made by Henkel Japan K.K., Japan) and 4 parts by weight of glycerol monostearate ester having a melting temperature of about 70° C. (Excel T-95, a product of Kao Sekken K.K., Japan) was used as the material for the precoating layer 4 on the heat transfer ink sheet 1 of Example 1, and with an ordinary paper recording sheet 17 widely used for melting type heat transfer (TKP-13, a product made by Kanzaki Seishi K.K., Japan; Bekk smoothness: about 170 seconds), recording was carried out in the same manner as in Example 1. Relationships between the turn-on time for heating and the optical density of recorded images for each of the primary colors are shown in FIG. 8. It can be seen therefrom that a substiantially equivalent recording to that of FIG. 7 could be obtained. In FIG. 8, curve Y shows Yellow, curve M Magenta and curve C Cyan. A clear color image could be obtained by recording of the primary colors one upon another.

EXAMPLE 3

Figure 9:
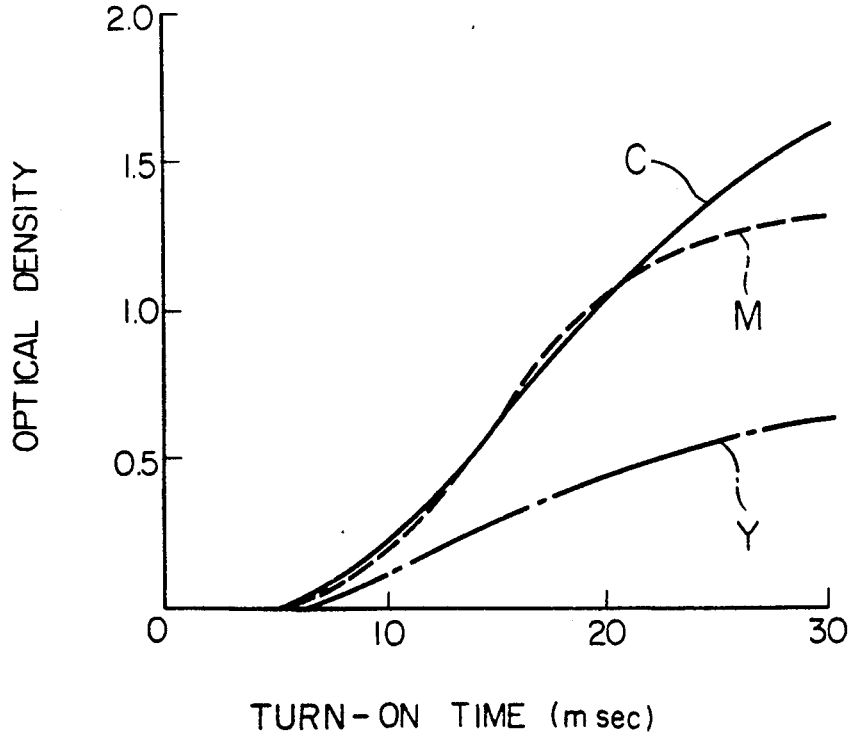

With the same heat transfer ink sheet 1 as used in Example 1 except that ester wax having a melting temperature of about 100° C. (Kao Wax 230-2, a product of Kao Sekken K.K., Japan) was used as a material for the precoating layer 4 of the heat transfer ink sheet 1, and with an official postal card (Bekk smoothness: about 30 seconds) as a paper recording sheet 17, recording was carried out in the same manner as in Example 1. Relationships between the turn-on time for heating and the optical density of recorded images for each of the primary colors are shown in FIG. 9, where curve Y shows Yellow, curve M Magenta and curve C Cyan. It can be seen therefrom that substantially the same results as in FIG. 7 could be obtained.

EXAMPLE 4

An ink sheet 1 or 11 was prepared by providing precoating layer regions 4 or 13 and ink layer regions 2 or 14, 15 and 16 on one side of a polyethylene terephthalate sheet 12, 6 μm thick, provided with a heat cured silicone resin layer (KS-722, a product made by Shinetsu Silicone K.K., Japan) on the other side. That is, the precoating layer 4 or 13 was formed by applying a solution of 3 parts by weight of polyester resin having a number average molecular weight of 6,000 and a softening temperature of 102° C. (ATR-2005, a product made by Kao Sekken K.K., Japan) in 7 parts by weight of tetrahydrofuran to the polyethylene terephthalate sheet 12, followed by drying. The ink layers 2 or 14, 15 and 16 were formed by applying a solution of 1 part by weight of a sublimable dye and 2 parts by weight of polyester resin (Vylon 290, a product made by Toyobo K.K., Japan) in 27 parts by weight of tetrahydrofuran to the polyethylene terephthalate sheet 12, followed by drying. The sublimable dye was C.I. Disperse Yellow 3 (Kayaset Yellow 937, a product made by Nihon Kayaku K.K., Japan) for Yellow ink, C.I. Disperse Violet 17 (Kayaset Red 130, a product made by Nihon Kayaku K.K., Japan) for Magenta ink, and C.I. Solvent Blue 36 (Kayaset Blue 136, a product made by Nihon Kayaku K.K., Japan) for Cyan ink.

With the thus obtained heat transfer ink sheet 1 or 11 and with the same Xerox 4024 paper as used in Example 1 as a recording sheet 17, recording was carried out with a heat transfer printer having a thermal head 18 (element density: 6 elements/mm).

Transfer of the precoating layer 4 or 13 from the ink sheet 1 or 11 to the recording sheet 17 was carried out by applying a voltage of 7.0 V to the thermal head 18 for a turn-on time of 20 m sec. per line of the thermal head 18. The precoating layer 4 or 13 could be uniformly transferred from the base film 3 or 12 of the heat transfer ink sheet 1 or 11 onto the recording sheet 17. Then, Yellow, Magenta and Cyan dyes were heat transferred from the ink sheet 1 or 11 onto the transferred precoating layer 4 or 13 on the recording sheet 17 in sequence according to the respective image signals, whereby a clear full color image could be obtained on the recording sheet 17.

Relationships between the turn-on time for heating and the optical density of recorded image when the individual dyes were heat transferred singly from the respective Yellow, Magenta and Cyan ink layers onto the transferred precoating layer 4 or 13 on the recording sheet 17 according to the present example are given in Table 1.

TABLE 1

| Dye | Turn-on time (m sec.) | Optical density: Example 4 | Conventional Example | Comparative |
|---|---|---|---|---|
| Yellow | 10 | 0.25 | 0.28 | 0.04 |
| | 15 | 0.43 | 0.45 | 0.08 |
| | 20 | 0.68 | 0.71 | 0.14 |
| Magenta | 10 | 0.41 | 0.40 | 0.05 |
| | 15 | 0.93 | 0.92 | 0.10 |
| | 20 | 1.28 | 1.29 | 0.19 |
| Cyan | 10 | 0.46 | 0.45 | 0.06 |
| | 15 | 0.94 | 0.97 | 0.13 |
| | 20 | 1.40 | 1.41 | 0.21 |

(Voltage applied: 7.0 V)

It can be seen from Table 1 that the recorded images according to the present example had substantially equivalent optical densities to those obtained with the conventional specific sheet (conventional example) and have considerably higher optical densities than those of the comparative example wherein no precoating layer is used, and the recording sheet 17 is Xerox 4024 paper. Thus, a clear recording of high density could be obtained by heat transferring a precoating layer 4 or 13 onto the recording sheet 17 in the present invention, even if an ordinary, versatile paper sheet was used as a recording sheet 17.

EXAMPLE 5

Heat transfer recording was carried out in the same manner as in Example 4, except that polyester resin having a number average molecular weight of 3,400 and a softening temperature of 105° C. (ATR-2009, a product made by Kao Sekken K. K., Japan) was used as a material for the precoating layer 4 or 13 and a recording sheet 17 (TKP-13, a product made by Kanzaki Seishi K. K., Japan; Bekk smoothness: about 280 seconds) was used in place of the material for the precoating layer 4 or 13 and the recording sheet 17 of Example 4, respectively. The precoating layer 4 or 13 could be uniformly heat transferred onto the recording sheet 17, and Yellow, Magenta and Cyan dyes could be also transferred onto the transferred precoating layer 4 or 13 on the recording sheet 17 according to the respective image signals, whereby a clear image could be recorded.

Separately, when Yellow, Magenta and Cyan dyes were heat transferred singly onto the transferred precoating layer 4 or 13 on the recording sheet 17, images of equal or a little higher optical density than that of Example 4 could be obtained.

COMPARATIVE EXAMPLE 2

Heat transfer recording was carried out in the same manner as in Example 5 recept that polyester resin having a number average molecular weight of 20,000 and a softening temperature of 158° C. (Vylon 103, a product made by Toyobo K. K., Japan) was used as a material for the precoating layer 4 or 13. About half of the precoating layer region 4 or 13 (total area) could not be heat transferred onto the recording sheet 17, and remained on the base film 3 or 12 of the heat transfer ink sheet 1 or 11. That is, the precoating layer 4 or 13 could not be uniformly heat transferred onto the recording sheet 17.

EXAMPLE 6

Heat transfer recording was carried out in the same manner as in Example 4 except that polyester resin having a number average molecular weight of 7,400 and a softening temperature of 136° C. (ATR-2010, a product made by Kao Sekken K. K., Japan) was used as a material for the precoating layer 4 or 13 and a bond paper having a low surface smoothness (Bekk smoothness: about 5 seconds) (13C, a product made by Southworth Co., USA) was used as a recording sheet 17. The precoating layer 4 or 13 could be uniformly heat transferred onto the recording sheet 17, and then Yellow, Magenta and Cyan dyes could be heat transferred onto the transferred precoating layer 4 or 13 on the recording sheet 17 according to the respective image signals, whereby a clear image could be recorded.

Separately, when Yellow, Magenta and Cyan dyes were heat transferred singly onto the transferred precoating layer 4 or 13 on the recording sheet 17, images of equal or a little lower optical density than that of Example 4 could be obtained.

COMPARATIVE EXAMPLE 3

Heat transfer recording was carried out in the same manner as in Example 6, except that polyester resin having a number average molecular weight of 2,300 and a softening temperature of 180° C. (Vylon 200, a product made by Toyobo K. K. Japan) was used as a material for the precoating layer 4 or 13. Almost all of the precoating layer 4 or 13 could not be heat transferred onto the recording sheet 17 and remained on the base film 3 or 12 of the heat transfer ink sheet 1 or 11.

EXAMPLE 7

A heat transfer ink sheet 1 or 11 was prepared by providing separation-facilitating layer regions l on one side of a polyethylene terephthalate sheet 3 or 12, 6 μm thick, having an ultraviolet-cured silicone resin layer (X-62-7245, a product made by Shinetsu Silicone K.K., Japan) on the other side, providing precoating layer regions 4 or 13 on the separation-facilitating layer regions l and Yellow ink layer regions 2Y, Magenta ink layer regions 2M and Cyan ink layer regions 2C on the remaining parts of the polyethylene terephthalate sheet 3 or 12 without the separation-facilitating layer regions l alternately in the sequence shown in FIG. 1, and further providing separation-facilitating layers l only on the surfaces of the individual ink layer regions 2Y, 2M and 2C

That is, the separation-facilitating layers l as the underlayer for the precoating layer regions 4 or 13 were formed by applying a mixture composed of 10 parts by weight of a solution containing 10% by weight of silicone (KS-772, a product made by Shinetsu Silicone K.K., Japan) in toluene and 0.5 parts by weight of a solution containing 0.5% by weight of a curing catalyst (CL-3, a product made by Shinetsu Silicone K.K., Japan) in n-hexane to the base film 3 or 12 (polyethylene terephthalate sheet), followed by dying at room temperature and heating at a temperture of 80° to 100° C. for 3 minutes. The precoating layers 4 or 13 were formed by applying a solution containing 30% by weight of polyester resin having a softening temperature of 155° C. (Vylon 600, a product made by Toyobo K.K., Japan) in tetrahydrofuran to the separation-facilitating layers l, followed by drying.

The same inks as in Example 4 were used for the ink layers 2 or 14, 15 and 16, except that C.I. No. Disperse Red 59 (Kayaset Red 026, a product made by Nihon Kayaku K.K., Japan) was used for the Magenta ink.

The separation-facilitating layer l on the ink layer regions 2 or 14, 15 and 16 of primary colors were formed by applying a solution containing 5% by weight of ultraviolet-curable type silicone (X-62-7223, a product made by Shinetsu Silicone K.K., Japan) in n-hexane to the surfaces of the ink layer regions 2 or 14, 15 and 16 followed by drying and irradiation of ultraviolet rays from a 120-W mercury lamp for 10 seconds. The thus formed separation-facilitating layers l had a thickness of about 0.5 μm.

With the thus prepared heat transfer ink sheet 11 and with a Xerox 4024 paper (Bekk smoothness: about 50 seconds), heat transfer recording was carried out by means of a heat transfer printer. Heat transfer of the precoating layer 13 onto the recording sheet 17 was carried out by voltage applied to the thermal head 18 of 7.5 V and turn-on time into the thermal head 18 of 20 m sec. per line the precoating layer 13 could be uniformly heat transferred from the ink sheet 11 onto the recording sheet 17. The ink sheet 11 could be smoothly separated from the recording sheet 17 after the heat transfer. Then, the ink layer regions 14, 15 and 16 of the heat transfer ink sheet 11 were laid on the transferred precoating layer 13 on the recording sheet 17, and Yellow, Magenta and Cyan dyes were heat transferred and received in succession thereon according to the respective image signals under a voltage of 7.5 V applied to the thermal head 18, whereby a clear full color image was obtained. The heat transfer ink sheet 11 could be smoothly separated from the recording sheet 17 after the heat transfer recording, and no abnormal transfer phenomenon in which ink layers 14, 15 and 16 adhere to the recording sheet 17 and peel from the base film 12 of the heat transfer ink sheet 11 was observed.

Separately, the precoating layers 13 were heat transferred onto the recording sheet 17 and then the sublimable dyes were heat transferred singly from the respective Yellow, Magenta and Cyan ink layers 14, 15 and 16 onto the transferred precoating layer 13 on the recording sheet 17. The relationships between the turn-on time for heating per line of the thermal head 18 and the optical density of the transferred images thus obtained are given in the following Table 2.

TABLE 2

| Dye | Turn-on time (m sec.) | Optical density Example 7 |
|---|---|---|
| Yellow | 10 | 0.29 |
| | 15 | 0.49 |
| | 20 | 0.76 |
| Magenta | 10 | 0.48 |
| | 15 | 1.02 |
| | 20 | 1.37 |
| Cyan | 10 | 0.51 |
| | 15 | 1.04 |
| | 20 | 1.50 |

(Voltage applied: 7.5 V)

COMPARATIVE EXAMPLE 4

A heat transfer ink sheet 1 or 11 was prepared in the same manner as in Example 7 except that no separation-facilitating layers were provided on the surfaces of the ink layer regions. The precoating layer 4 or 13 was heat transferred from the ink sheet 1 or 11 onto the recording sheet 17 and then the sublimable dyes were transferred thereon from the respective ink layers 2 or 14, 15 and 16 in the same manner as in Example 7. The ink layers 2 or 14, 15 and 16 and the precoating layer 4 or 13 adhered to each other because of the absense of the separation-facilitating layers l on the surfaces of the ink layers 2 or 14, 15 and 16, and the ink sheet 1 or 11 could not be separated from the recording sheet 17 in the heat transfer printer. When the ink sheet 1 or 11 was forcedly separated from the recording sheet 17, parts of the ink layers 2 or 14, 15 and 16 were peeled off the base film 3 or 12 and remained on the recording sheet 17.

EXAMPLE 8

Figure 10:
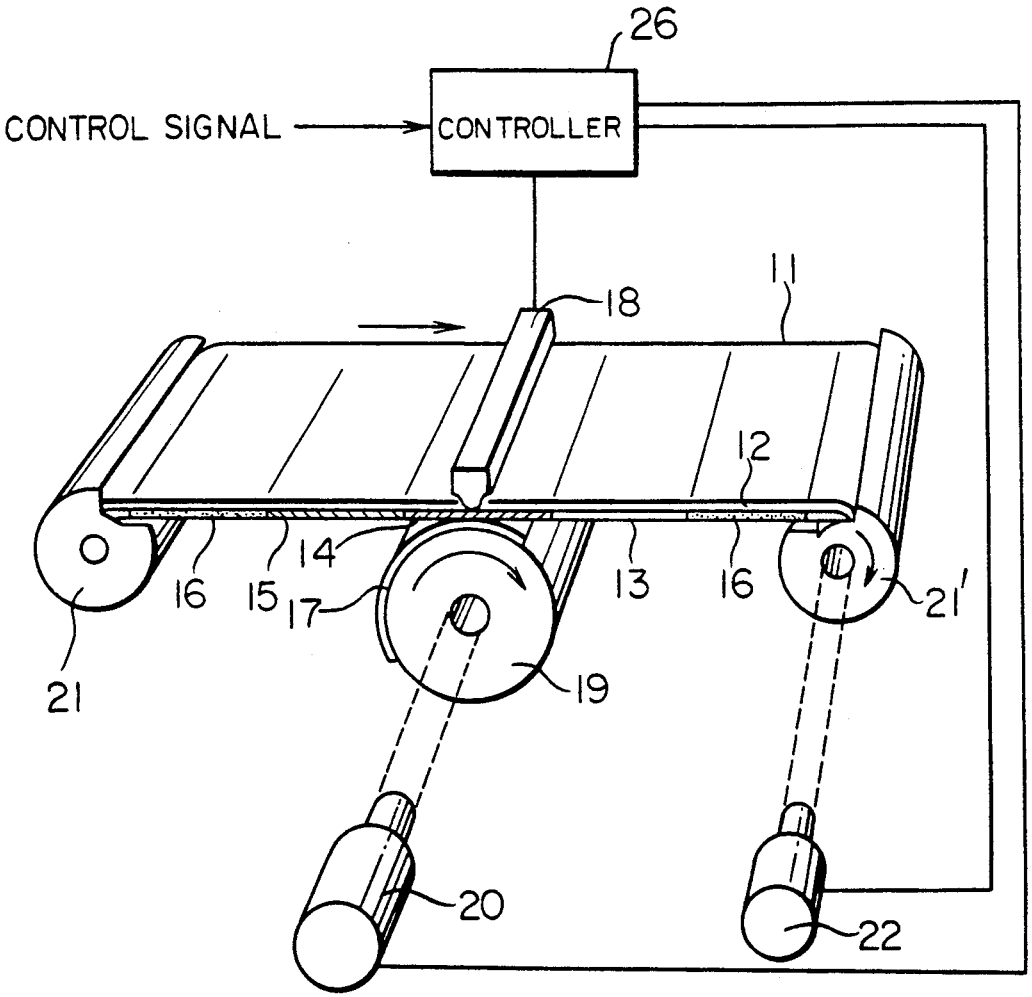
FIG. 10 is a schematic view of a heat transfer printer.

As shown in FIG. 10, an ink sheet 11 having precoating layer regions 13 formed in the same manner as in Example 7 is rolled in a roller 21. The precoating layer regions 13, Yellow ink layer regions 14, Magenta ink layer regions 15 and Cyan ink layer regions 16 were provided on a base sheet 12 alternately in succession, and were subjected to heat transfer in a heat transfer printer as shown in FIG. 10.

A platen roller 19 and an ink sheet winding roll 21' are driven by motors 20 and 22, respectively, controlled by external signals to lay the precoating layer region 13 of the ink sheet 11 on a recording sheet 17 composed of an ordinary, versatile paper sheet. Then, the ink sheet 11 is pressed onto the recording sheet 17 by a thermal head 18 to heat the precoating layer 13. By the heating of the ink sheet 11, the precoating layer 13 is peeled off the base sheet 12 and transferred onto the image recording region on the recording sheet 17.

Then, the motor 20 is driven to make one turn of the recording sheet 17 by the platen roller 19, and at the same time the motor 22 is driven to move the ink sheet 11 in the arrow direction to lay the Yellow ink layer region 14 on the recording sheet 17. The ink sheet 11 and the transferred precoating layer 4 or 13 on the recording sheet 17 is pressed by the thermal head 18 to selectively heat the Yellow ink layer region 14 while making the thermal head 18 selectively heat by a controller 26 based on an external signal. The Yellow dye in the ink layer region 14 is sublimated thereby to form an image of the dye on the transferred precoating layer 4 or 13 on the recording sheet 17.

Then, the recording sheet 17 is made to turn one turn and at the same time the ink sheet 11 is moved in the arrow direction in the same manner as above to lay the Magenta ink layer region 15 on the Yellow image-recorded transferred precoating layer 4 or 13 on the recording sheet 17. An image of Magenta dye is formed on the precoating layer 4 or 13 thereby.

Likewise, an image of Cyan dye is formed on the transferred precoating layer 4 or 13 from Cyan ink layer region 16.

A clear full color image could be thus formed and recorded on the recording sheet 17. The ink sheet 11 could be used to smoothly form successive images on the recording sheet 17 without sticking to the thermal head 18 or adhering to the recording sheet 17.

A clear letter or image can be recorded on an ordinary versatile paper sheet, using the present heat transfer ink sheet 11. Furthermore, precoating layers 13 can be formed only at the necessary parts on the recording sheet 17, and thus other parts can remain as the ordinary, versatile paper sheet 17, and thus it is possible to make additional writing or ordinary printing, etc. on the remaining ordinary, versatile paper sheet parts. Thus, the present invention has many additional industrial values.

What is claimed is:

1. A process for printing a colored image on a recording sheet, which comprises the steps of:

preparing an ink sheet which is provided with on one surface thereof an ink layer region containing a sublimable or vaporizable dye and a precoating layer region for a precoating layer, said precoating layer region being adjacent to said ink layer region and both regions being arranged alternately, the precoating layer region being made of an organic material having at least one of an ester bond and an amide bond and being capable of being easily dyed with the dye in the ink layer region, wherein said ink sheet is further provided with a first silicone resin layer over said ink layer region and a second silicone resin layer between said precoating layer region and a base sheet of said ink sheet;

bringing the precoating layer region of the ink sheet into contact with the surface of the recording sheet;

heating the precoating layer region by a thermal heat controlled by a controlling means so as to effect transfer of the precoating layer region to the surface of the recording sheet;

bringing the ink layer region of the ink sheet into contact with the surface of the transferred precoating layer on the recording sheet; and effecting sublimation or vaporization of the dye in the ink layer region by heat from the thermal heat so as to transfer the dye into the transferred precoating layer wherein said first silicone resin layer prevents adhering of the ink layer region remaining on the ink sheet to the transferred precoating layer and wherein said second silicone resin layer facilitates separation of said precoating layer from said ink sheet during transfer of said precoating layer region to the surface of the recording sheet.

2. An ink sheet for printing a colored image on a recording sheet, which comprises:

a base sheet;

an ink layer region containing a sublimable or vaporizable dye, formed on the base sheet;

a precoating layer region for a precoating layer, formed on the base sheet in the precoating layer region being formed adjacent to the ink layer region and being made of an organic material having at least one of an ester and an amide bond and being capable of being easily dyed with the dye in the ink layer region;

a first silicone resin layer formed on said ink layer region; and a second silicone resin layer formed between said precoating layer region and said base sheet for facilitating separation of said precoating layer region from said base sheet.

3. An ink sheet for a heat transfer printer for forming a letter or image or both by laying a heat transfer ink sheet provided with an ink layer region containing a heat-sublimable or vaporizable dye, selectively heating the ink sheet by a thermal head controlled by a controlling means, thereby sublimating or vaporizing the dye, and selectively heat transferring the dye onto a recording sheet, wherein the ink sheet comprises a base sheet, precoating layer regions capable of forming a precoating layer for receiving the dye on the recording sheet by heat transfer and ink layer regions, the precoating layer regions and the ink layer regions being provided on the base sheet alternately in succession, and further comprising adhesion-preventing composed mainly of silicone resin provided on the surfaces of the ink layer regions, wherein the precoating layer regions formed on the base sheet are each composed of an organic material having at least one of an ester bond and an amide bond, and having a heat transfer temperature of 50° to 250° C. at which the precoating layer regions are transferred onto the recording sheet.

4. An ink sheet for a heat transfer printer according to claim 5, wherein the precoating layer regions provided on the base sheet are each composed of at least one of polyester resin, polyamide resin, higher fatty acid esters, and higher fatty acid amides.

5. A process for printing a colored image on a recording sheet, which comprises the steps of:

preparing an ink sheet which is provided with on one surface thereon an ink layer region containing a sublimable or vaporizable dye and a region for a precoating layer, only the surface of the ink layer region being covered with an adhesion preventing layer, the precoating layer region being adjacent to the ink layer region and both regions being arranged alternately, the precoating layer region being made of an organic material having at least one of an ester bond and an amide bond and being capable of being easily dyed with the dye in the ink layer region;

bringing the precoating layer region of the ink sheet into contact with the surface of the recording sheet;

heating the precoating layer region by a thermal head controlled by a controlling means so as to effect transfer of the precoating layer region to the surface of the recording sheets;

bringing the ink layer region of the ink sheet into contact with the surface of the transferred precoating layer through the adhesion preventing layer; and effecting sublimation or vaporization of the dye in the ink layer region by heat from the thermal head so as to transfer the dye into the transferred precoating layer, while the adhesion preventing layer prevents adhering of the ink layer remaining on the ink sheet to the precoating layer.

6. The process according to claim 5, wherein the organic material having at least one of an ester bond and an amide bond has a heat transfer temperature of 50° C. to 250° C. at which the precoating layer region is transferred onto the recording sheet.

7. The process according to claim 5, wherein the ink layer region on the ink sheet comprises three segments of Cyan, Magenta and Yellow.

8. An ink sheet for printing a colored image on a recording sheet, which comprises, a base sheet;

ink layer regions each containing a sublimable or vaporizable dye, formed on the base sheet;

precoating layer regions formed on the base sheet;

and an adhesion preventing layer for preventing adhering of the ink layer remaining on the ink sheet to the precoating layer transferred onto the recording sheet, formed on the surface of the ink layer;

wherein the precoating layer region is formed adjacent to the ink layer region, the precoating layer is made of an organic material having at least one of an ester bond and an amide bond and being capable of being easily dyed with the dye in the ink layer region.

9. The ink sheet according to claim 8, wherein the organic material having at least one of an ester bond and an amide bond has a heat transfer temperature of 50° C. to 250° C. at which the precoating layer regions are transferred onto the recording sheet.

10. The ink sheet according to claim 8, wherein the ink layer region on the ink sheet comprises three segments of Cyan, Magenta and Yellow.

* * * * *